United States Patent [19]

Crane et al.

[11] 4,014,694

[45] Mar. 29, 1977

[54] METHOD AND APPARATUS FOR FORMING A POSITIVE ELECTROSTATIC IMAGE

[75] Inventors: Hewitt D. Crane, Portola; Gerald L. Pressman, Cupertino; George J. Eilers, Redwood City, all of Calif.

[73] Assignee: Electroprint, Inc., Cupertino, Calif.

[22] Filed: Feb. 18, 1975

[21] Appl. No.: 550,406

Related U.S. Application Data

[62] Division of Ser. No. 281,605, Aug. 17, 1972, Pat. No. 3,867,673.

[52] U.S. Cl. ..... 96/1 R; 96/1 SD

[51] Int. Cl.[2] ..... G03G 13/052

[58] Field of Search ..... 355/3 SC, 4, 16, 17; 96/1 R, 1 SD

[56] References Cited

UNITED STATES PATENTS

| | | | |
|---|---|---|---|
| 3,689,935 | 9/1972 | Pressman et.al. | 101/DIG. 13 |
| 3,694,200 | 9/1972 | Pressman | 355/3 |
| 3,713,734 | 1/1973 | Crane et al. | 355/3 |
| 3,796,490 | 3/1974 | Pressman et al. | 96/1 R |
| 3,839,027 | 10/1974 | Pressman | 96/1 R |
| 3,867,673 | 2/1975 | Crane et al. | 319/262 R |

*Primary Examiner*—John D. Welsh
*Attorney, Agent, or Firm*—Townsend and Townsend

[57] ABSTRACT

A machine for making a copy on a medium such as paper of a visual image. Particles of toner material are accelerated toward the paper through an apertured screen. Formed on the screen is a pattern of electrostatic charge regions that corresponds to the image so that the arrangement of the toner particles impinging on the paper corresponds to the image. A composite apertured screen composed of two conductive layers separated by an insulative layer and having an insulative layer on one outer surface. Means for establishing oppositely polarized fields across the inner insulative layer and across the outer insulative layer. One of the fields is selectively discharged to control the passage of toner particles through the apertures in the screen.

5 Claims, 7 Drawing Figures

METHOD AND APPARATUS FOR FORMING A POSITIVE ELECTROSTATIC IMAGE

This is a division of application Ser. No. 281,605, filed Aug. 17, 1972, now U.S. Pat. No. 3,867,783.

This invention relates to a method and apparatus for forming a planar pattern of electrostatic charge regions that are arranged to correspond to an image; the invention has particular application in a system for reproducing on a suitable medium, such as paper, a copy of a visible image.

Systems for reproducing images as mentioned above are exemplified in U.S. Pat. applications Ser. No. 673,499, filed Oct. 6, 1967, Ser. No. 776,146, filed Nov. 15, 1968, and Ser. No. 85,070, filed Oct. 29, 1970, which are incorporated hereinto by this reference. Such systems can include a support for a medium such as paper on which it is desired to form a visible image. The system also can include a source of particles that have a color contrasting with that of the medium. (Such particles are typically referred to as "toner", and such usage will be employed hereinafter). In one type of system, there is interposed between the toner supply and the medium an apertured screen. An electrostatic field between the source of the toner particles and the medium is established to propel the particles toward the medium through the apertures in the screen. A plurality of electrostatic charge regions is formed by the screen in a pattern that corresponds to the image so that electrostatic fields within the apertures selectively control passage of toner particles. Toner particles egressing from the apertured screen therefore conform to the pattern of the image. After the toner particles impinge on the medium they can be fixed or fused thereon, if required, in accordance with known technology to provide a permanent image.

In another type of system, e.g., the systems described in U.S. Pat. applications Ser. No. 709,578, filed Mar. 1, 1968; Ser. No. 864,022, filed Oct. 6, 1969; and Ser. No. 101,681, filed Dec. 28, 1970, ions or like charged particles are formed into a suitable pattern which pattern can be directed through a cloud of toner particles. The screen according to the present invention is useful in both types of system or in any other system in which formation of a pattern of charged particles is required.

In the systems described above, the present invention provides an improved screen that offers certain advantages over various prior screens. The screen construction according to the present invention operates at a relatively low voltage thereby simplifying fabrication and operation of the device.

The embodiment of the invention described in more detail hereinafter includes a composite apertured screen formed by four layers. On the upstream or obverse face or the screen, the side facing the source of toner particles, the composite screen has a conductive layer underlying which is an insulative layer. On the downstream face of the insulative layer is a second conductive layer underlying which is an outer insulative layer; the exposed surface of the outer insulative layer constitutes the downstream or reverse face of the screen.

The improved screen is incorporated into the system by so biasing the two conductive layers that within the apertures is established an electrostatic blocking field that has a polarity and magnitude sufficient to block the passage of toner particles through the apertures. The outer insulative layer is selectively electrostatically charged to a polarity and magnitude sufficient to form a field that counteracts and overrides portions of the blocking field to afford passage of toner particles in a pattern corresponding to an image.

In one satisfactory embodiment of the invention, the outer insulative layer is formed of photoconductive material, a material that has a high resistance when in a dark state and a low resistance when in an illuminated state. While in the dark state, the photoconductive layer is charged to a polarity and magnitude sufficient to create fields within the apertures that override or counteract the abovementioned blocking field. Consequently, when the screen is in a dark state, all apertures are biased to permit passage of toner particles traveling from the toner particle source to the medium. The image to be copied on the medium is then projected on the photoconductive layer so that portions of that layer that correspond to light parts of the image assume a conductive state. In such state, the charge previously formed on the photoconductive layer is discharged thereby correspondingly discharging the counteracting field to permit the blocking field to become effective. Consequently, apertures residing in such illuminated portions block the flow of toner particles whereas apertures associated with dark portions of the screen continue to permit passage of toner particles. With the screen in such condition a supply of charged toner particles is directed through the screen to the medium as a consequence of which the particles egressing from the screen are arranged in a pattern directly or positively corresponding to the image.

The objects, features and advantages of the present invention will be more apparent after referring to the following specification and accompanying drawings in which.

Figure 1:
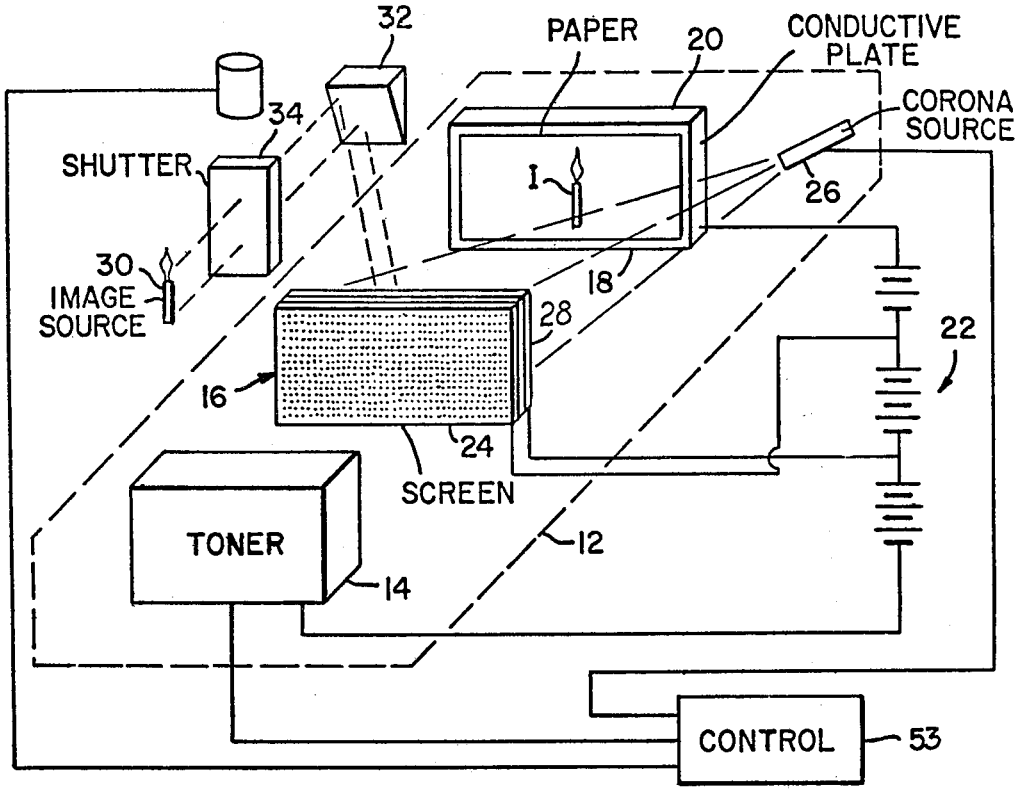
FIG. 1 is a diagrammatic view of a system employing the screen of the present invention.

Referring more particularly to the drawings and specifically to FIG. 1, reference numeral 12 schematically indicates an air and light impervious enclosure in which a system employing the improved screen of the invention is enclosed. Mounted within enclosure 12 is a source of toner particles 14, a composite apertured screen 16, an image receiving medium 18 and a conductive support 20 for the medium. A power source 22 is provided for establishing a field between toner source 14 and conductive plate 20 so that toner particles are accelerated from the toner source to the conductive plate. Screen 16 defines a large plurality of apertures 24 in which apertures appropriate fields are established either to block or to pass toner particles in accordance with the shape of an image I to be formed on medium 18.

Within enclosure 12 is a charged particle source, such as a corona source 26, which is employed to form a uniform charge on the reverse surface 28 of screen 24. After such uniform charge is formed, an image source 30 is projected onto the reverse surface of screen 24 through an optical system that includes a reflector 32 and a shutter mechanism 34. Illumination of reverse face 28 of screen 24 alters the charge pattern within the apertures of screen 24 so that toner particles egress from the screen apertures in a pattern corresponding to image source 30, whereby the image I is formed on medium 18.

Figure 2:
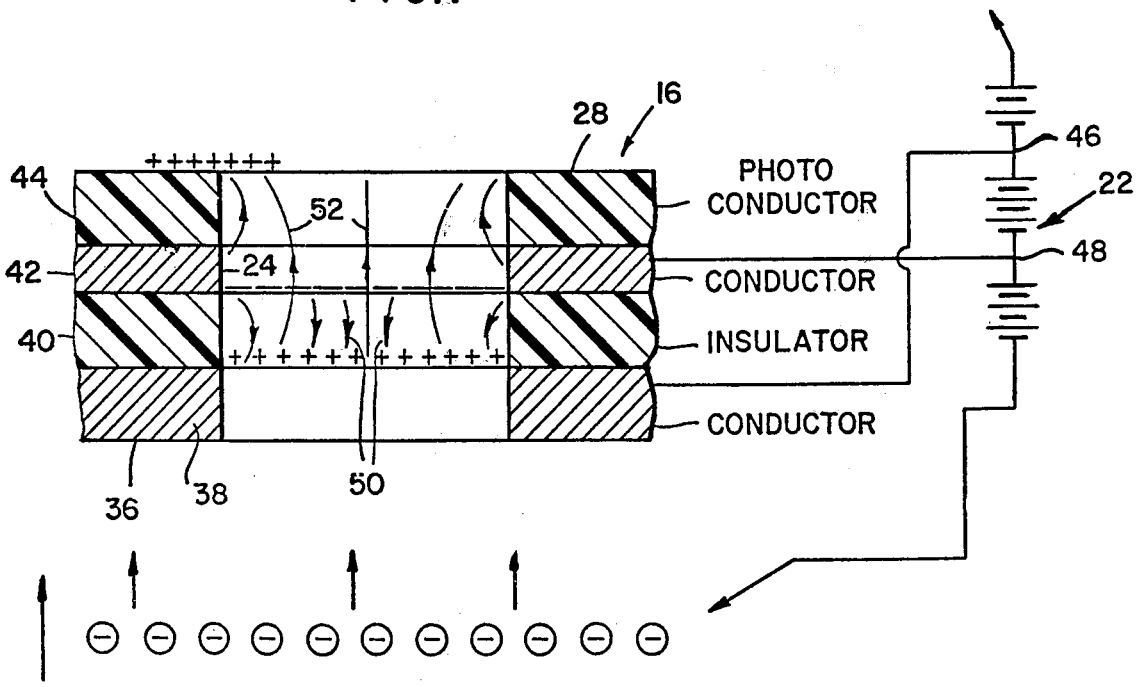
FIG. 2 is an enlarged fragmentary view of a screen according to the present invention showing the position of the electrostatic fields within an aperture.

A satisfactory embodiment of screen 16 is fragmentarily shown at greatly enlarged size in FIG. 2. The screen includes an obverse face 36 that faces toward the source of toner particles. Obverse face 36 is defined by a conductive layer 38 underlying which is an insulative layer 40. On the surface of insulative layer 40 opposite from conductive layer 36 is a second or inner conductive layer 42; screen 16 is structurally completed by a layer 44 of photoconductive material the outer surface of which defines reverse surface 28 of screen 16. In one screen designed according to the present invention insulative layer 40 and photoconductive layer 44 have thicknesses of approximately 0.001-inch and conductive layers 38 and 42 are thin films deposited on such insulative layers. In such exemplary structure apertures 24 have a diameter of approximately .006-inch and as shown in the figure, the apertures extend through all layers so that each layer terminates in the wall bounding the apertures.

Blocking fields are formed within apertures 24 by establishing a bias or potential between conductive layers 38 and 42 that has a magnitude and polarity sufficient to form a charge across insulative layer 40 that creates the blocking field. For this purpose, and assuming that toner particle source 14 is biased to charge toner particles with a negative charge, conductive layer 38 is biased positively with respect to conductive layer 42. Such bias is achieved by connecting a tap 46 in power source 22 to conductive layer 38 and by connecting a tap 48 of the power source to conductive layer 42. The effect of such bias is to form at the surface of insulative layer 40 that abuts conductive layer 38 a plurality of positive charges and at the surface of the insulator that abuts conductive layer 42 a plurality of negative charges; the fringe of such charges within each aperture 24 form an electrostatic field within the aperture identified by field lines 50 which have a magnitude and polarization sufficient to block passage of toner particles through the aperture. In the exemplary structure referred to above, a potential between conductive layers 38 and 42 of about 200–300 volts is considered adequate to form a field within aperture 24 that totally blocks passage of toner particles through the aperture.

In order to permit passage of toner particles through aperture 24, the present invention provides for creation of an electrostatic field that counteracts or overrides the field designated by field lines 50. In FIG. 2 the field lines of the counteracting field are identified by reference numeral 52. Such counteracting field is formed by impressing on surface 28 of photoconductive layer 44, while such layer is in the dark or nonconductive state, charges of a suitable polarity, positive charges in the case exemplified in the drawings. Such charges can be formed by any suitable expedient, for example, by bombardment of surface 28 with positive ions from a corona wand, radioactive source, or the like. In any event, the charges impressed on reverse surface 28 are of a magnitude and polarity such that the counteracting field indicated by field lines 52 is formed by the cooperation of the charge on surface 28 and the charges existing on the surfaces of inner insulative layer 40. In the example depicted in the drawings, the charges formed on reverse face 28 are more positive than the charges arising from the bias supplies connected to conductive layers 38 and 42.

The directional arrows associated with field lines 50 and 52 in the drawings merely depict that the fields are oppositely polarized. Obviously, the direction of the field or the force resulting therefrom depends upon the polarity of the charge on the toner particles and not on any convention adopted for the purpose of illustrating the invention. Similarly, the blocking and counteracting fields may be viewed in the singular or in the plural for a given screen.

The field formed between the charges on reverse face 28 and the charges on the surfaces of inner insulator 40 cause fringe fields within aperture 24 that have a magnitude and direction sufficient to counteract blocking field 50 to the end that the toner particles can pass through aperture 24, a condition that subsists so long as conductive layer 44 is retained in a dark state.

Projection of image I onto reverse surface 28 illuminates all portions of the conductive layer except those areas corresponding to the location of dark lines and/or areas of the image. Those portions of photoconductive layer 44 that are illuminated become locally conductive so that current flow through the layer is permitted. Such current flow discharges counteracting field 52 in all apertures 24 that are associated with light portions of image I so that only blocking field 50 exists in such apertures. In apertures corresponding to dark areas of the image, however, no current flow occurs through photoconductive layer 44 as a consequence of which counteracting fields 52 subsist in such apertures. Thus, even after removal of the image from reverse face 28, an electrostatic image remains on screen 16 so that when an accelerating or projection field is activated to move toner particles from source 14 to conductive plate 20, only apertures corresponding to dark portions of image I will admit and pass toner particles to medium 18. All other apertures, i.e., apertures corresponding to regions of screen 16 that have been illuminated, will block passage of toner particles since in such apertures only blocking field 50 is effective. Consequently, a positive image is formed on medium 18 by the toner particles and such image can be made permanent by subsequent fixing or fusing of the toner particles on medium 18.

A typical image projected on the reverse face of screen 16 includes regions that have no contrasting information, regions that are completely black (or other contrasting color), and regions that are intermediate the two extremes (e.g., varying degrees of gray). The present invention permits accurate reproduction of all regions of the image. When the image is projected on photoconductive layer 44, regions of the layer become conductive in proportion to the intensity of light impinging thereon. Regions of the photoconductive layer corresponding to bright or highlight portions of the image are maximally illuminated and therefore substantially totally discharged. Regions of the photoconductive layer corresponding to gray portions of the image are only partially illuminated and therefore only partially discharged. Regions of the photoconductive layer, corresponding to black portions of the image are not illuminated and therefore not discharged. Accordingly, passage of toner particles through various apertures 24 in screen 16 occurs in direct proportion to the position and relative intensity in the image.

Figure 3:
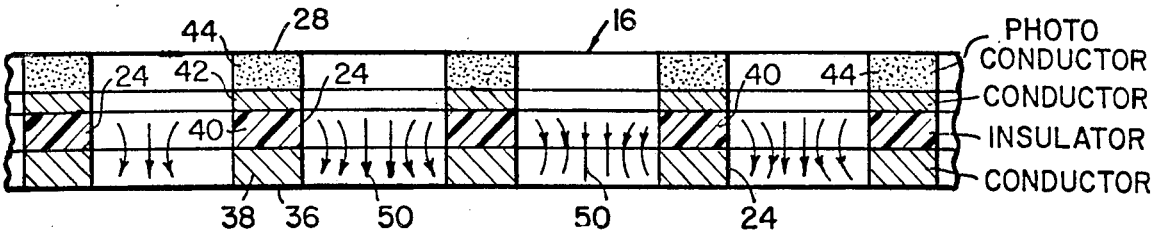
FIG. 3 is a fragmentary view of a larger portion of a screen constructed according to the present invention.
Figure 4:
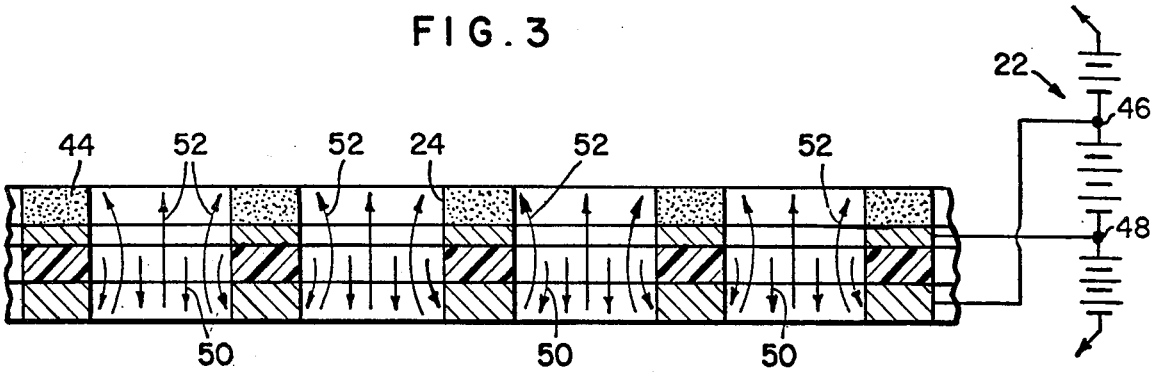
FIG. 4 is a fragmentary view similar to FIG. 3 showing the charged condition of the screen prior to receiving an image thereon.

The control functions referred to above are carried out in accordance with conventional techniques and circuitry, and such conventional circuitry is indicated schematically in FIG. 1 by reference numeral 53. To recapitulate the operation of the present invention, reference is now made to FIGS. 3–5. FIG. 3 depicts screen 16 as it exists after power source 22 has been activated. In such condition, a potential difference between inner electrode 42 and outer electrode 38 establishes blocking fields 50 within each aperture 24 so that any negatively charged toner particles approaching the obverse face, the lower face as viewed in FIGS. 3, 4 and 5, will be blocked and, therefore, will not pass through the apertures in the screen. FIG. 4 depicts the screen after a charge from particle source 26 has been impressed on photoconductive layer 44 while the screen is in a dark condition. In such state, counteracting fields 52 are established within apertures 24 which fields fully or partially override blocking fields 50 so that the net effect within each aperture so affected is that toner particles approaching the screen will pass through the screen.

Figure 5:
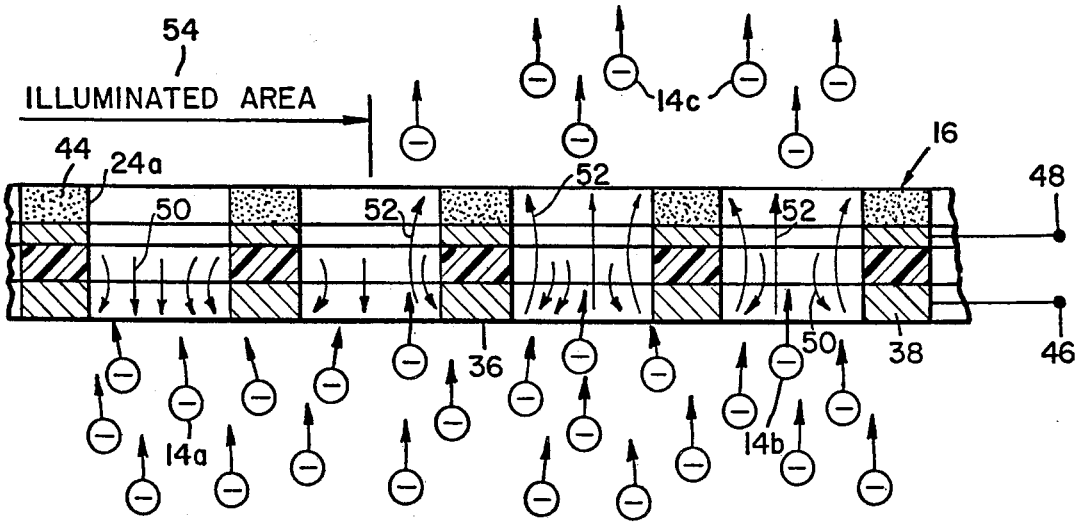
FIG. 5 is a view similar to FIGS. 3 and 4 showing the charged condition to the screen after a visible image has been impressed on the photoconductive layer thereon.

In FIG. 5, the region to the left labeled illuminated area" and indicated by reference numeral 54 corresponds with portions of an image that are clear, or bright, whereas the remainder of the screen corresponds with portions of the image that are black or of some other contrasting color. In illuminated area 54, photoconductive layer 44 becomes locally conductive and the charges thereon that sustain counteracting field 53 are dissipated. Consequently, as to the apertures within the illuminated area, e.g., aperture 24a, blocking field 50 is solely effective so that toner particles, e.g., 14*a*, are repelled by the field and do not pass through aperture 24*a*. As to the apertures that were not illuminated by the image, however, the counteracting field remains effective to override the blocking field so that the toner particles, e.g., 14*b*, can pass through such apertures. Those apertures in regions of the screen that are partially illuminated will pass toner particles in reduced quantities. Accordingly, an image is formed downstream, i.e., above, as viewed in FIG. 5, of the plate 16 by toner particles identified by reference number 14*c*.

Figure 6:
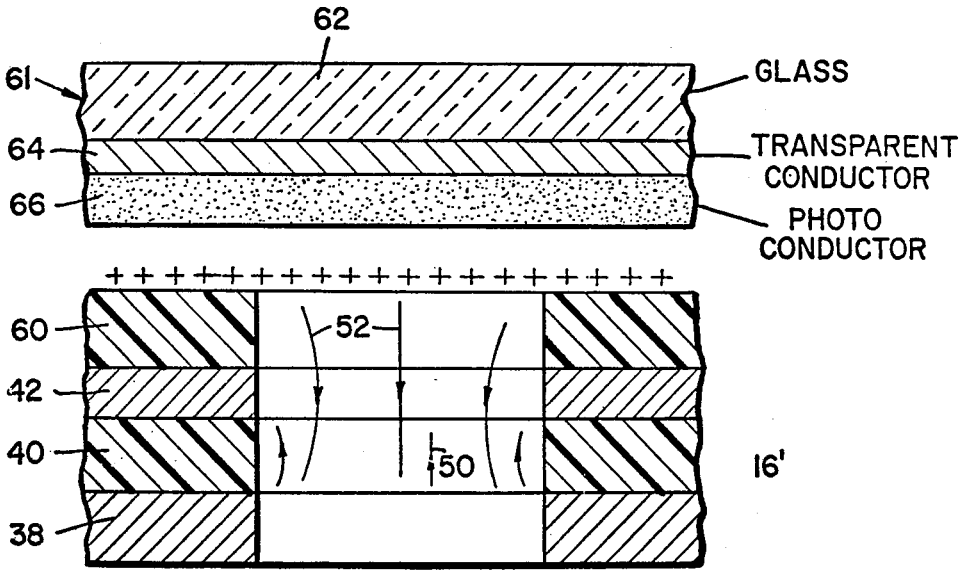
FIG. 6 is a diagrammatic view similar to FIG. 1 showing an alternate embodiment of the invention.
Figure 7:
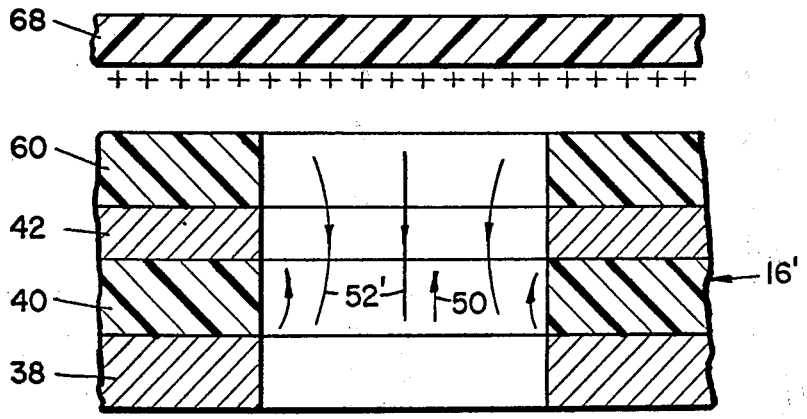
FIG. 7 is a diagrammatic view of another alternate embodiment of the invention.

Several alternate techniques for establishing counteracting fields are shown in FIGS. 6 and 7. In such figures, a modified screen 16′ is shown. In such modified screen, conductive layers 38 and 42 and inner insulative layer 40 are identical to the structure described above and therefore bear identical reference numerals; in the modified screen, however, photoconductive layer 44 is replaced by an insulative or dielectric layer 60 that is insensitive to light. Because layer 60 is formed of insulative material, it can store a charge in the dark or in the light in the same manner that photoconductive layer 44 stores a charge when in a dark condition.

In the embodiment shown in FIG. 6, it is assumed that counteracting fields 53 have been established by impression of a charge on conductive layer 60 in a manner equivalent to that described hereinabove; i.e., by bombardment from a corona source or the like. A multilayered discharge plate 61 on which has been formed an electrostatic image corresponding to the visible image desired, is moved into contact with insulative layer 60 for selectively discharging counteracting fields 52.

Plate 61 includes a transparent support layer 62 on one surface in which is placed a thin, transparent conductive layer 64. Overlying transparent conductive layer 64 is a photoconductive layer 66 adapted for contact with insulative layer 60 of screen 16′. A suitable bias potential is applied to the plate by connection to conductive layer 64. In a dark condition, plate 61 is moved into contact with insulative layer 60 after which the visible image is projected through transparent layers 62 and 64 onto photoconductive layer 66. The regions of the photoconductive layer that are illuminated become conductive and therefore discharge fields 52 on corresponding regions of plate 16′. Consequently, the charge distribution on insulative layer 60 is selectively modified in accordance with the image projected onto plate 61 so that upon removal of the plate and acceleration of toner particles through screen 16′, the toner particles will be arranged in accordance with the visible image.

FIG. 7 shows still another modification wherein screen 16′ is idential to that described above in connection with FIG. 6. The embodiment of FIG. 7 includes a plate 68 on which has been formed a latent electrostatic image in accordance with the procedures disclosed in U.S. Pat. Applications Ser. No. 673,499 and Ser. No. 776,146. The charges on plate 68 that define an electrostatic latent image thereon are transferred to the surface of insulative layer 60 of screen 16′ when the plate is brought into physical contact with the screen. Such charges form counteracting fields 52 in only those apertures through which it is desired to admit toner particles. Thus, by employing the modification of FIG. 7, the intermediate step of impressing counteracting field 52 throughout the entire area of the screen is eliminated.

Thus, it will be seen that the present invention provides an improved screen for forming an electrostatic image which is positive in reference to a visual image, to the end that positive images on a suitable medium can be formed by a screen according to this invention. Moreover, the screen is capable of operation at relatively low voltages and is of relatively uncomplex construction.

Although several embodiments of the invention have been shown and described, it will be obvious that other adaptations and modifications can be made without departing from the true spirit and scope of the invention.

What is claimed is:

1. The method of electrostatic printing or copying which includes controlling the flow of electrostatically charged particles through apertures which comprises the steps of forming a first field within said apertures that is so polarized and of a magnitude sufficient to block passage of the flow of the electrostatically charged particles through the apertures, forming a second field within said apertures that has a polarity opposite from and a magnitude greater than said first field so as to counteract said first field within said apertures, selectively discharging said second field in accordance with the image to be printed or copied, and modulating the flow of the electrostatically charged particles in accordance with that image by passing them through the apertures.

2. A method for controlling the flow of a stream of charged particles comprising:

establishing a coplanar array of a first plurality of bipolar electrostatic fields having a strength and orientation for blocking the flow of a stream of charged particles directed through the array;

superimposing a coplanar array of a second plurality of bipolar electrostatic fields over said first plurality of bipolar electrostatic fields, said second plurality of bipolar electrostatic fields being oriented in the opposite direction from said first plurality of fields and having a strength sufficient to counteract said fields;

selectively reducing the strength of the second plurality of bipolar electrostatic fields in accordance with an image to be reproduced; and then imagewise modulating the flow of the stream of charged particles by directing the stream of charged particles through the array.

3. The method of electrostatic printing which comprises the steps of:

providing a screen means having an array of apertures therein;

establishing blocking fields effective within the apertures;

establishing counteracting fields, in accordance with an image to be reproduced, selectively within the apertures and spaced from the blocking fields;

and directing charged particles through the screen means in accordance with the charge pattern effective within the apertures to a receiving medium.

4. A method for electrostatically modulating the flow of a stream of charged particles through a multi-layer apertured member comprising the steps of:

establishing a coplanar array of a first plurality of bipolar electrostatic fields substantially confined within the apertures of the apertured member, uniformly oriented, and having substantially uniform strength sufficient for blocking the flow of a stream of charged particles directed through the array;

and selectively superimposing over said first array a second coplanar array of a second plurality of bipolar electrostatic fields, said second fields being uniformly oriented in the opposite direction from said first plurality of fields, and having selected magnitude for selectively conteracting the first plurality of fields in the configuration of an image to be reproduced.

5. The method of claim 4 wherein said superimposing step comprises the steps of forming an array composed of a second plurality of bipolar electrostatic fields coextensive with the first fields, the second fields having a polarity and magnitude sufficient to counteract the first fields, selectively discharging at least one of the second fields.

* * * * *